US009648968B1

(12) United States Patent
Alme

(10) Patent No.: US 9,648,968 B1
(45) Date of Patent: May 16, 2017

(54) MATERIALS FOR THE MOUNTING AND DISPLAY OF RECORD ALBUMS OR STANDARD SIZE ARTWORK

(71) Applicant: Kenneth John Alme, Oakdale, MN (US)

(72) Inventor: Kenneth John Alme, Oakdale, MN (US)

(73) Assignee: 12 Inch Art, LLC, Oakdale, MN (US)

( * ) Notice: Subject to any disclaimer, the term of this patent is extended or adjusted under 35 U.S.C. 154(b) by 0 days.

(21) Appl. No.: 14/807,917

(22) Filed: Jul. 24, 2015

Related U.S. Application Data

(60) Provisional application No. 61/999,350, filed on Jul. 24, 2014.

(51) Int. Cl.
*A47G 1/16* (2006.01)
*A47B 81/06* (2006.01)

(52) U.S. Cl.
CPC ..... *A47G 1/1686* (2013.01); *A47B 81/067* (2013.01)

(58) Field of Classification Search
CPC ..... A47G 1/1686; A47B 81/067
USPC .... 211/40, 41.12; 52/235, 474, 415, 506.01, 52/506.06, 578; 40/618
See application file for complete search history.

(56) References Cited

U.S. PATENT DOCUMENTS 1,400,438 A * 12/1921 Jaquette ..... G09F 7/08 40/124
1,644,742 A * 10/1927 Moynihan ..... G09F 7/10 40/576
1,887,591 A * 11/1932 Fugita ..... G09F 7/08 40/597
1,989,289 A * 1/1935 Piazza ..... E04F 13/0803 52/144
2,038,978 A * 4/1936 Adler ..... G09F 7/08 40/576
2,113,285 A * 4/1938 Wamser ..... G09F 7/10 40/618
2,319,910 A * 5/1943 Adler ..... G09F 7/08 40/576
3,387,397 A * 6/1968 Buchanan ..... G09F 7/02 40/618
3,407,525 A * 10/1968 Connell ..... G09F 7/08 40/618
3,742,633 A * 7/1973 Palm ..... G09F 7/08 40/576
4,107,887 A * 8/1978 Wendt ..... E04B 1/86 52/105
4,497,125 A * 2/1985 Hutchinson ..... G09F 1/10 211/40

(Continued)

*Primary Examiner* — Brent W Herring

(57) ABSTRACT

A mounting system for displaying an object on a vertical surface. The system includes a first horizontal rail configured to be attached to the vertical surface. The first rail has a channel defined by a pair of side surfaces extending along its longitudinal length and the channel has a sufficient width to receive an edge of the object. A second horizontal rail is configured to be attached to the vertical surface at a vertical distance from the first rail. The second rail has two channels defined by side surfaces extending along its longitudinal length, with each of two channels opening on a respective top and bottom of the rail so that the second rail has a generally cross-sectional "H" shape. Each channel is wide enough to receive an edge of the object. The system further includes a spacer bar used to assist in the installation of the rails.

9 Claims, 7 Drawing Sheets

(56) References Cited

U.S. PATENT DOCUMENTS 4,516,373 A * 5/1985 Osawa ..... E04F 13/0803 52/387
4,584,950 A * 4/1986 Adams ..... G11B 23/0236 211/40
4,650,702 A * 3/1987 Whitmyer ..... E06B 3/5427 428/31
4,769,965 A * 9/1988 Shaub ..... E04B 9/241 52/506.07
4,969,304 A * 11/1990 Helderman ..... E04B 9/241 52/780
5,058,300 A * 10/1991 Ernest ..... G09F 7/18 40/606.18
5,119,567 A * 6/1992 Fox ..... E04F 21/1883 249/214
5,191,718 A * 3/1993 Fox ..... E04C 1/42 249/214
5,224,314 A * 7/1993 Chen ..... E04F 21/1883 52/306
5,245,808 A * 9/1993 Grunewald ..... E06B 3/5427 52/204.593
5,288,534 A * 2/1994 Tavshanjian ..... E04F 21/0092 33/518
5,351,835 A * 10/1994 Hallgren ..... A47B 81/068 211/40
5,357,701 A * 10/1994 Grate ..... G09F 7/10 40/618
5,623,800 A * 4/1997 Shinkosky ..... E04F 19/062 52/202
5,634,305 A * 6/1997 Erlanger ..... E04B 2/86 52/235
5,702,090 A * 12/1997 Edgman ..... E04H 17/1421 256/19
5,709,058 A * 1/1998 Shaw ..... E04B 2/707 52/282.1
5,860,257 A * 1/1999 Gerhaher ..... E04F 10/10 52/235
5,901,486 A * 5/1999 Sharon ..... G09F 7/10 40/568
5,924,256 A * 7/1999 Ito ..... E04B 2/58 52/243
5,930,926 A * 8/1999 Kaplan ..... G09F 7/10 40/124.4
6,055,787 A * 5/2000 Gerhaher ..... E04F 13/0826 52/506.06
6,205,731 B1 * 3/2001 Gerhaher ..... B28B 3/26 52/235
6,216,375 B1 * 4/2001 Griffin ..... G09F 7/10 40/618
6,289,644 B1 * 9/2001 Gerhaher ..... E04F 13/0826 52/235
6,289,646 B1 * 9/2001 Watanabe ..... E04F 13/083 52/235
7,596,911 B2 * 10/2009 Turco ..... E04F 19/062 52/127.6
7,726,083 B2 * 6/2010 Wagner ..... E04F 13/0812 52/235
7,743,575 B2 * 6/2010 Ito ..... E04F 13/0889 52/461
7,814,711 B2 * 10/2010 Milligan ..... E06B 1/6076 52/126.4
7,849,651 B2 * 12/2010 Fujito ..... E04F 13/0803 248/216.1
7,874,113 B2 * 1/2011 Eberle, III ..... E04F 15/04 52/403.1
7,908,812 B2 * 3/2011 Eberle, III ..... E04F 15/04 52/489.1
7,954,267 B2 * 6/2011 Anzalone ..... G09F 7/18 40/611.06
7,987,648 B1 * 8/2011 Ryan ..... E04F 13/0846 52/235
8,161,702 B2 * 4/2012 Eberle, III ..... E04F 15/04 403/231
8,287,206 B2 * 10/2012 Eberle, III ..... E04F 15/04 403/12
8,567,140 B2 * 10/2013 Wagner ..... E04F 13/0805 52/235
8,689,474 B2 * 4/2014 Garfinkle ..... G09F 7/10 40/611.05
9,057,201 B2 * 6/2015 Milligan ..... E04F 21/1877
9,228,362 B2 * 1/2016 Eberle, III ..... E04F 15/04
2003/0070337 A1 * 4/2003 Music ..... G09F 7/10 40/618
2006/0265988 A1 * 11/2006 Fujito ..... E04F 13/0889 52/511
2008/0010922 A1 * 1/2008 Wagner ..... E04F 13/0812 52/235
2008/0134605 A1 * 6/2008 Friesen ..... E04C 1/42 52/308
2010/0154336 A1 * 6/2010 Wagner ..... E04F 13/0805 52/235
2013/0192148 A1 * 8/2013 Milligan ..... E04F 21/1877 52/126.4

* cited by examiner

MATERIALS FOR THE MOUNTING AND DISPLAY OF RECORD ALBUMS OR STANDARD SIZE ARTWORK

CROSS REFERENCE TO RELATED APPLICATIONS

This application claims the benefit of U.S. Provisional Patent Application No. 61/999,350 filed Jul. 24, 2014.

BACKGROUND

Prior to commercialization digital storage of recorded music, the preferred medium of recorded music was the 33⅓ RPM vinyl record. Due to perceived sound quality, ease of use, and portability, digitally stored music, at first in the form compact discs and later in digital files that can be played on various devices substantially replaced vinyl records as the dominant music media, leaving many with record collections seldom, if ever, used. In many cases, these collections have been kept for sentimentality, perceived investment, or artistic value of the album cover art.

Vinyl records are currently enjoying a renaissance of sorts. With the growth in popularity of music downloaded from the internet directly to personal music devices, compact discs are falling from favor. At the same time, sales of vinyl records have been growing, both from new recordings by current musical artists and re-pressings of older music. This growth is primarily fueled by a younger generation of music listeners who have discovered the vinyl medium and believe it to be a superior medium to digital downloads for home listening and have the convenience of the digital downloads, which are often included with the purchase of the vinyl record album.

Additionally, many album covers also have artistic value not available with a digital download. Recording artists design their covers with great care, both as a means to communicate the content of their music and to generate "shelf" appeal to generate sales. Such album covers also often included lyrics and other information. It is likely that many record albums have been purchased not only for the musical content but also for the art of the album cover. In addition, music collectors may have a desire to display their collection as art. Accordingly, there is a demand for methods of displaying album collections. Likewise other collectors of other types of objects, such as comic books, photographs, comic books, baseball cards, and the like may similarly want to display their collection on a wall.

A number of display or storage devices for albums have been proposed. In some cases, such displays have provided for encasement of an album cover, e.g., behind glass in a picture-frame like display. However, such displays do not readily permit removal of the album covers or albums for playing and use in the manner for which they were designed. Other display devices accommodate album covers individually and require considerable effort to create a mosaic-like display of multiple album covers and at considerable expense.

SUMMARY

The present disclosure is directed to a system for displaying multiple record album covers or other standard-sized media on a generally vertical surface in a manner that allows for convenient removal and replacement of any of the displayed record albums for handling or play. The system allows for storage of single sleeve album covers and for storage of clamshell album covers in an open or closed configuration. In certain embodiments, multiple album covers are contained in the display, with access to individual album covers obtained substantially without moving or manipulating any of the accompanying album covers.

In accordance with one aspect of the disclosure, a system is provided for allowing simultaneous display of multiple album covers with independent access to individual album cover display areas. The device includes multiple wall mountable rail members for supporting multiple album covers in separate display areas such that one side of each of the album covers can be viewed. Each album cover is supported by two rails, a bottom rail which supports the weight of the album cover and a top rail which stabilizes the top edge of the album cover. In displays wherein multiple rows of album covers are displayed, the top rail of one row becomes the supporting/bottom rail of the row immediately above. Additionally, the system includes an installation rail, used in conjunction with the album covers, to determine with precision the distance between the top and bottom rails and facilitate mounting them to the wall. When mounted correctly, the installation rail is removed, leaving a gap between the top edge of the album cover and the uppermost horizontal surface of the lower channel of the top rail. This gap allows the user to lift the album cover a sufficient distance for the bottom edge of the album cover to swing away from the bottom rail and the album cover to be removed from the device. Accordingly, this independent access is provided to each of the album covers within the display such that any one of the display areas can be accessed for inserting or removing an album cover while the other cover(s) remain displayed in its display area for viewing. Such independent access advantageously reduces the need to handle album covers other than the one that the user desires to access, thereby simplifying access and reducing the potential of damage or wear.

DETAILED DESCRIPTION

The present disclosure is directed toward mounting objects on a generally vertical surface. More particularly, the present disclosure is directed toward mounting objects such as album covers in a mounting structure. Embodiments of such a mounting structure such as are described below allow for the display of multiple album covers or other media of a standard dimension, i.e. comic books, baseball cards, photographs, etc., and that further allow for convenient access to individual album covers or other media as may be desired. The embodiments allow for access to album covers or other objects via channels set in rails which are mounted in a fixed position to the wall such that any selected object from the display can be removed easily without removing any of the other objects. For the purposes of brevity and clarity, the embodiments below are discussed with respect to displaying album covers, but the embodiments mounting structures discussed herein may be advantageously used to mount various other objects besides album covers, some examples of which are discussed above. In other words, unless otherwise stated, the embodiments should not be understood as being limited to mounting album covers.

Figure 1:
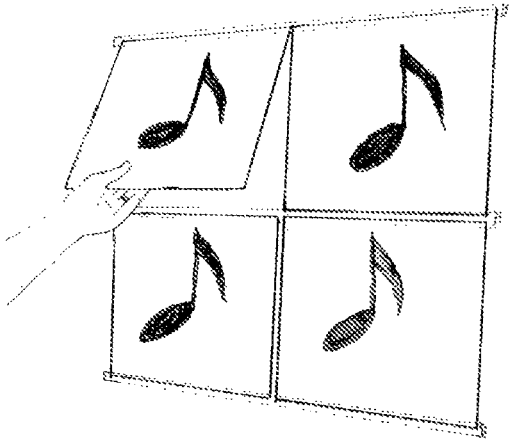
FIGS. 1-5 demonstrate embodiments of the present disclosure in various configurations and perspectives with differing quantities and sizes of media.

FIGS. 1-5 are provided to show how a display device or mounting structure of the present disclosure can be advantageously used to display objects such as album covers in a multiple row configuration. The display devices or mounting structures described below allow for simultaneous display of multiple album covers and for display of sleeve-type as well as clamshell album covers. FIG. 1 illustrates the invention installed in a configuration to accommodate four album covers and access afforded an individual cover. In the illustration, the user can remove or replace an album cover by inserting the upper edge of the album cover in the lower channel of the upper rail, then place the bottom edge of the album cover in the top channel of the lower rail. To remove, the user lifts the desired album cover a sufficient distance to achieve clearance from the lower rail, rotates the lower edge away from the wall and lowers the album until free from the lower channel of the upper rail.

Figure 2:
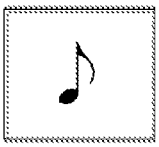
Figure 3:
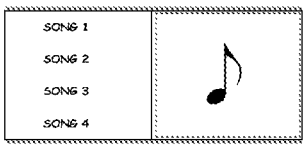

FIGS. 2-3 illustrate a sleeve-type album cover and a clamshell album cover respectively. In FIG. 2, a sleeve-type album cover is displayed with a top and bottom rail of the same length as the width of the album cover. A clamshell album cover as illustrated in FIG. 3 includes a front face and a rear face where the front face includes artwork, the name of the artist and/or album, and other information. The rear face typically identifies the album contents, e.g., identifies the songs or other material that is included on each side of the album.

A clamshell cover, as generally illustrated in FIG. 3, typically includes two panels that fold about a central crease. The front and rear sides of the album cover may include information similar to that on sleeve-type album covers. Additional artwork and other information, such as lyrics, may be printed on the inner surfaces (not shown). In the case of a clamshell album cover, it may be desired to display more than one surface of the album cover. For example, when the album cover is unfolded, the front and back surfaces can be simultaneously viewed from a single vantage point. In FIG. 3, a clamshell album cover is displayed with top and bottom rails of the same length as the combined width of the fully-unfolded panels.

Figure 4:
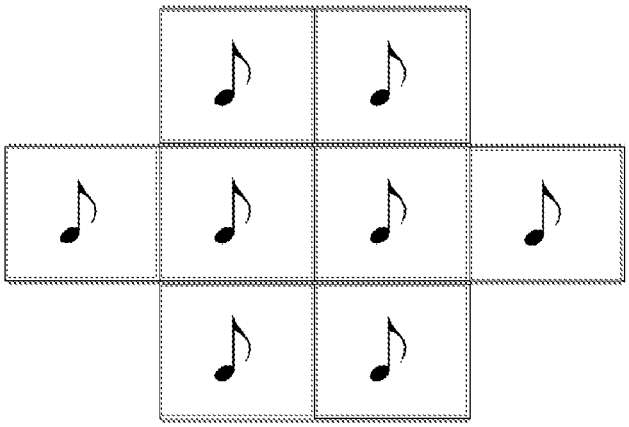
Figure 5:
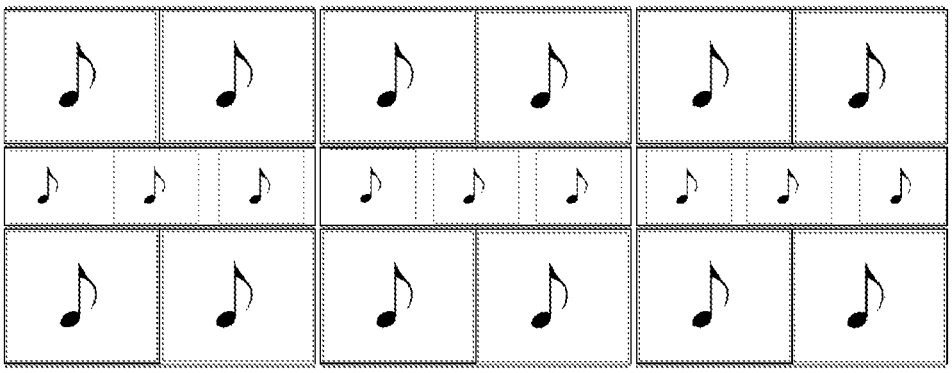

FIGS. 4-5 represent alternative configurations of album cover display devices in accordance with present disclosure. Referring first to FIG. 4, a display device is illustrated that includes eight album cover display areas arranged in three horizontal rows. Accordingly, the device may be used to display eight sleeve-type or folded clamshell album covers, four unfolded clamshell album covers or combinations thereof. All of the display areas may be accessed independently without disturbing the other album covers in the display by lifting the desired album out of the rails as described above.

Referring to FIG. 5, a display device is illustrated that includes six album covers and nine smaller media, commonly referred to as "45s" as they are single-song media, played at 45 revolutions per minute and have dimensions of seven inches tall and seven inches wide. In this illustration, the smaller-dimensioned media is placed in the middle row for artistic purposes. The display device allows for independent access to the smaller media in the same manner as the larger album covers. This illustration demonstrates an alternative implementation of the invention and adaptability of it to media of varying dimensions.

Figure 6:
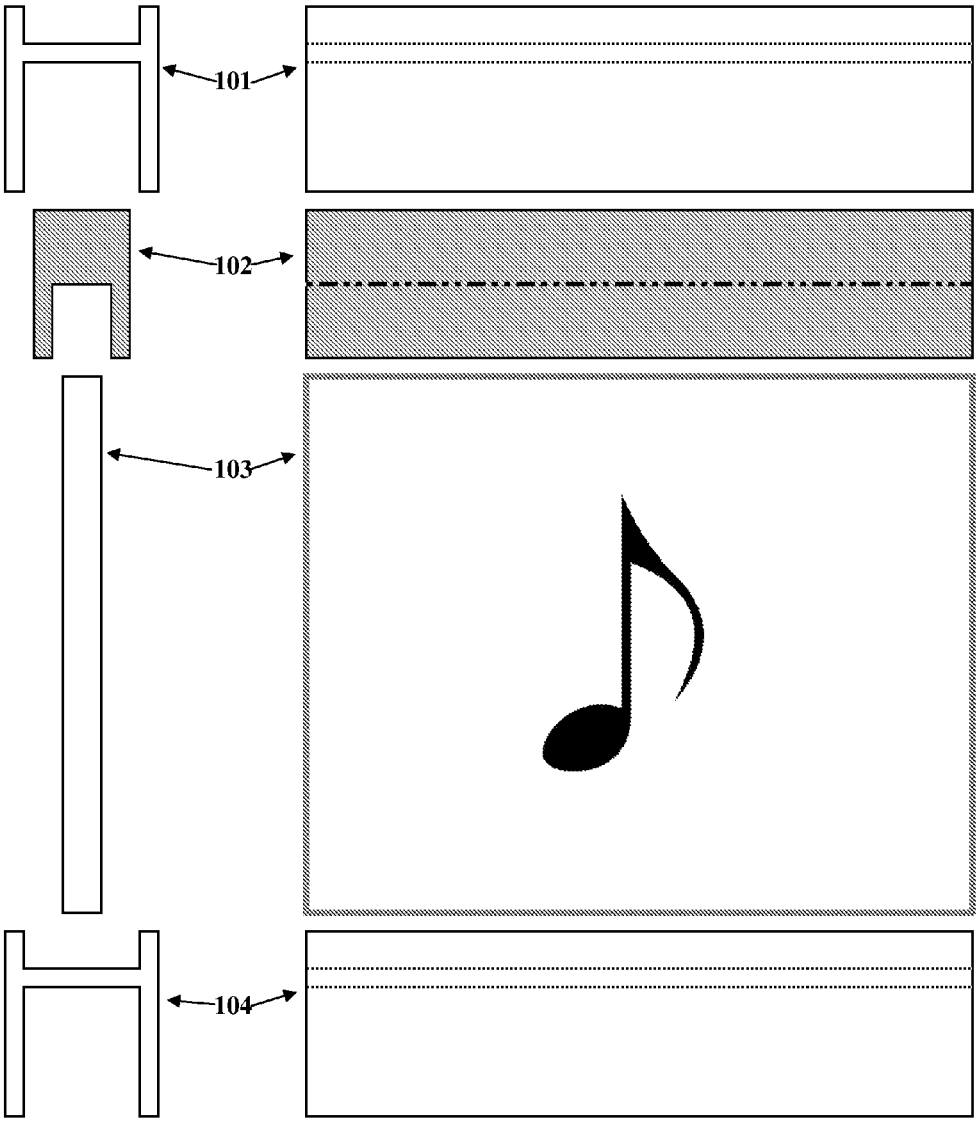
FIGS. 6-8 are side views and front perspective of the individual components of the album cover display device in accordance with one embodiment of the present disclosure.

FIGS. 6-11 illustrate embodiments of a mounting structure or display device suitable for mounting album covers or other display objects in accordance with present disclosure. FIG. 6 illustrates both front and side views in an exploded arrangement of the components of one embodiment of the album cover display device or mounting structure in accordance with the present disclosure. In particular, the components include first and second wall mountable supporting rails 101 and 104 and an installation rail 102. Also shown is a display object 103 in the form of an album cover. The display object 103 is not a component of the display device, but, as is described below, is advantageously employed to assist in the mounting of the display device to a wall or other generally vertical surface. The supporting rails 101 and 104 include an upper and lower channel, the upper channel being dimensionally shallower than the lower channel, both channels have a width sufficient to accommodate both sleeve-type or folded clamshell covers. In other embodiments, the width of the upper and lower channels may be of varying widths to accommodate various other display media. The supporting rails 101 and 104 can be of any suitable length and can be formed out of a number of different materials, including various polymers or metals. The supporting rails 101 and 104 can be manufactured in a number of different ways, including using an extrusion process or forming in a mold or a casting, to name a few.

The supporting rails 101 and 104 each have upper and lower channels to facilitate a multi-row display. A single supporting rail, then, can be used as the top channel in one row and the bottom channel in a row immediately above it. The absolute top and bottom supporting rails of a display can use supporting rails such as 101 and 104. Alternatively, supporting rails that have only a bottom and a top rail (not shown) can be used as the bottom and top supporting rails of a display, respectively.

The installation rail 102 is provided to assist in the positioning of the supporting rails, as will be discussed in more detail below. The installation rail 102, in one embodiment, has a lower channel which has a width sufficient to accommodate the upper edge of a sleeve-type album cover, has an overall thickness to fit loosely within the lower channel of the upper supporting rail 101. The installation rail 102 assists with positioning upper supporting rail 101 with respect to lower supporting rail 104. The installation rail 102 can be made out of similar materials and using similar processes as is used to make supporting rails 101, 104.

Figure 7:
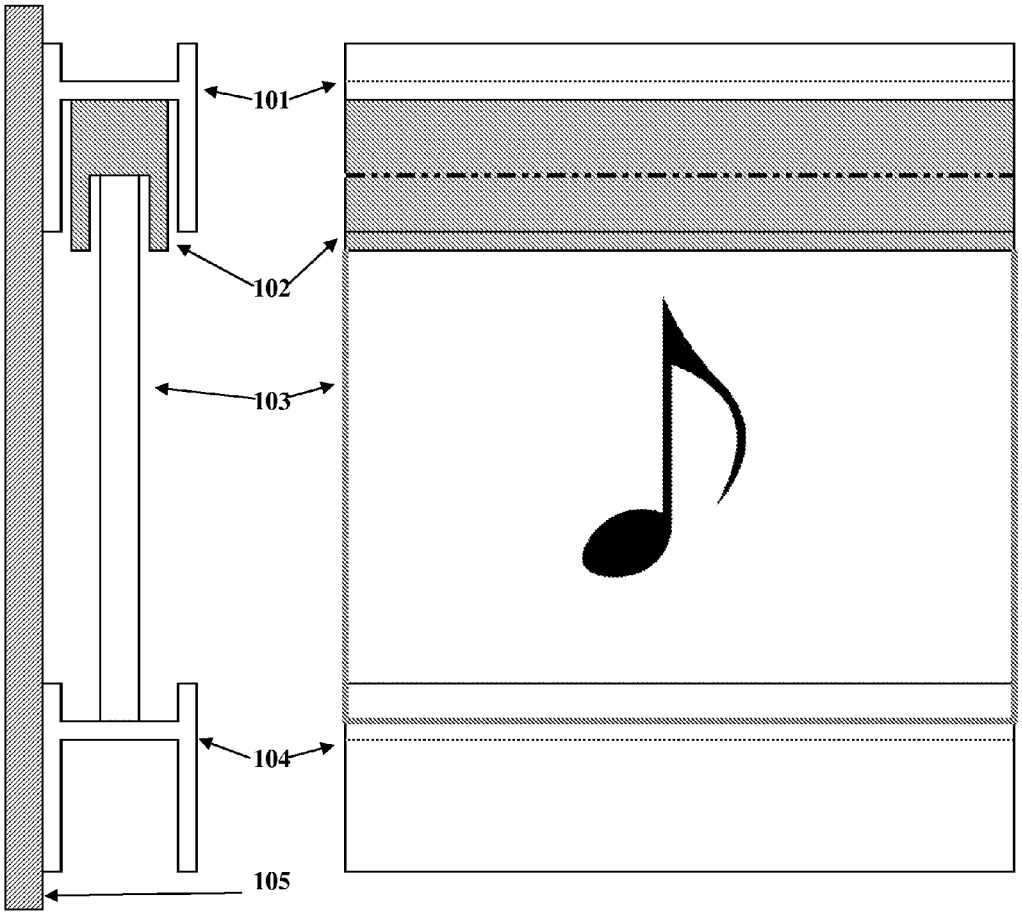

FIG. 7 illustrates a front and side view of the components of FIG. 6 embodiment of the album cover display device as it would appear during the installation process in accordance with the present disclosure. Supporting rail 104 is attached to wall 105 with a removable adhesive or some other suitable method, album cover 103 is placed on top of lower supporting rail 104, followed by placing the lower channel of installation rail 102 over the top edge of album cover 103. The lower channel of upper supporting rail 101 is then placed over the top of installation rail 102 and immovably attached to the wall using adhesive or some other method. The installation rail 102 is sized so that when the installation rail is placed on the album cover 103 the supporting rail 101 is placed on the installation rail and then secured to the wall, the distance between the upper surface of the bottom channel of supporting rail 101 and the bottom surface of the top channel of supporting rail 104 is more than the height of the album 103 by approximately one-half the distance from the lowermost point of upper supporting rail 101 and the upper surface of the lower channel. The installation rail 102 is used for ease of installation only, and is not intended to be part of the display device once the supporting rails are installed. The installation rail 102 can be used to install a plurality of rows for the display device.

Figure 8:
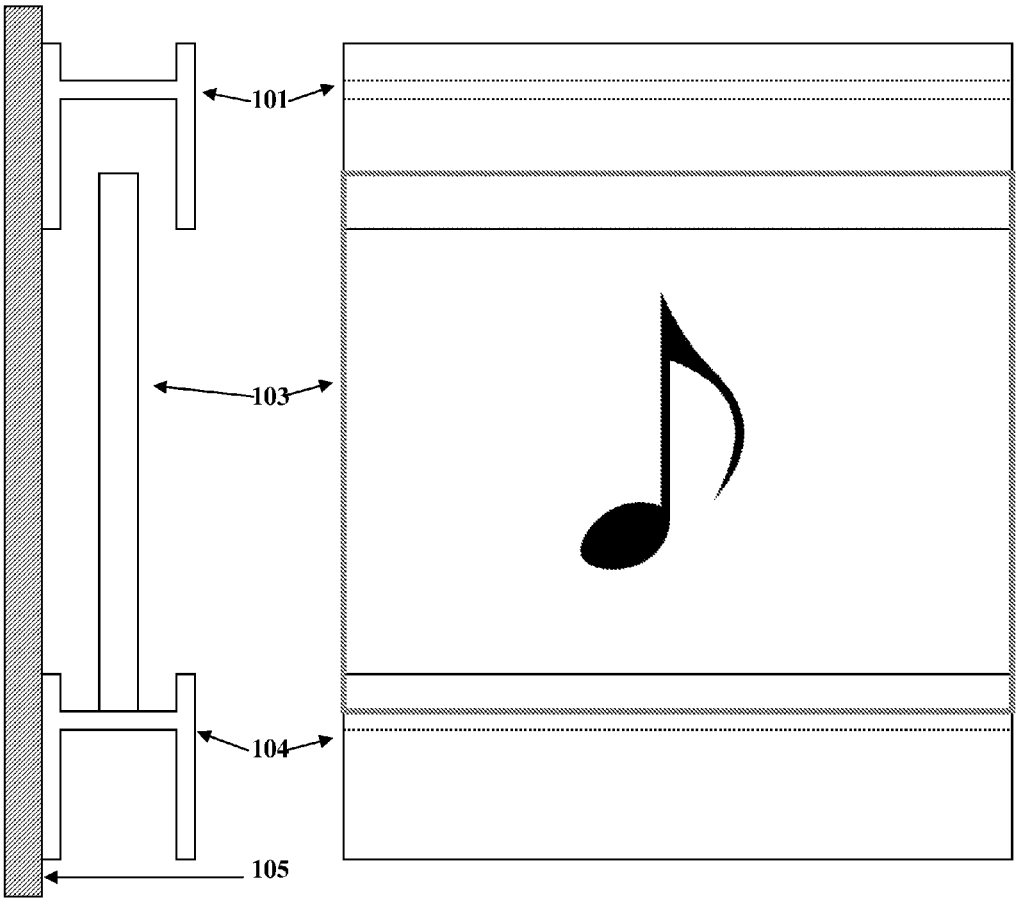

FIG. 8 illustrates a front and side view of the components of the FIG. 6 embodiment of the album cover display device as it would appear after the installation process is complete. In this illustration, upper and lower supporting rails 101 and 104 are immovably attached to wall 105, album cover 103 rests on top of lower supporting rail 104, with the top edge secured within the lower channel of upper supporting rail 101. Installation rail 102 (from FIGS. 7 and 8) has been removed, leaving the top edge of album cover 103 at approximately one-half the distance from the lowermost point of upper supporting rail 101 and the upper surface of the lower channel. This gap between the top edge of album cover 103 and the upper surface of the lower channel of upper supporting rail 101 allows the album cover 103 to be lifted a sufficient distance for the lower edge of album cover 103 to be removed from the upper channel of lower supporting rail 104 so that the album cover 103 can be removed completely from the system.

Figure 9:
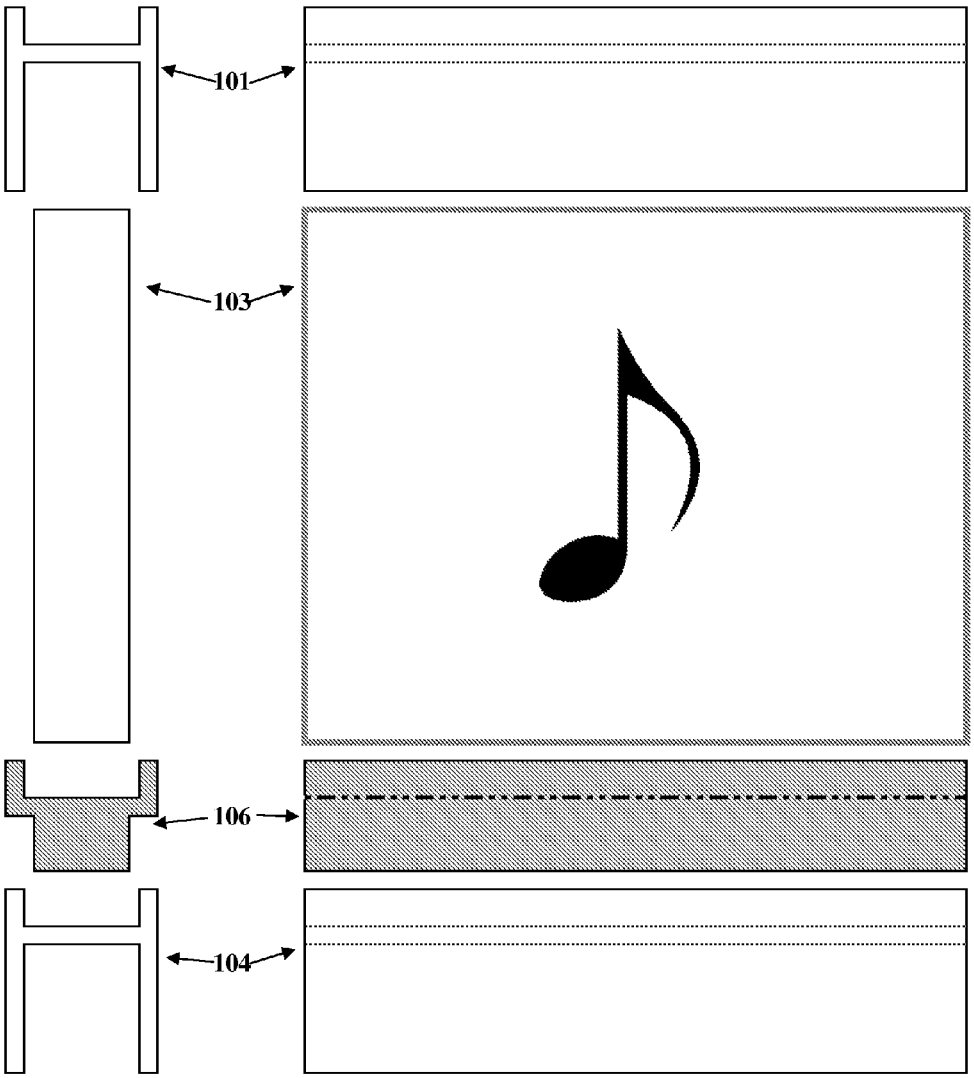
FIGS. 9-11 are side views and front perspective of the individual components of an alternative embodiment of the album cover display device in accordance with one embodiment of the present disclosure.

FIG. 9 illustrates a front and side view of the components of another embodiment of the album cover display device in accordance with the present disclosure, showing wall mountable supporting rails 101 and 104, installation rail 106 and album cover or media 103. The supporting rails 101 and 104 include an upper and lower channel, the upper channel being dimensionally shallower than the lower channel, both channels have a width sufficient to accommodate media of various thickness. The installation rail 106 has an upper channel which has a width sufficient to accommodate any media with a thickness less than the width of the channels of supporting rails 101 and 104. In this embodiment the present disclosure could be used to display media with a variety of dimensions, i.e. foam-core poster board. The base of installation rail 106 is narrow to fit within the upper channel of supporting rail 104.

Figure 10:
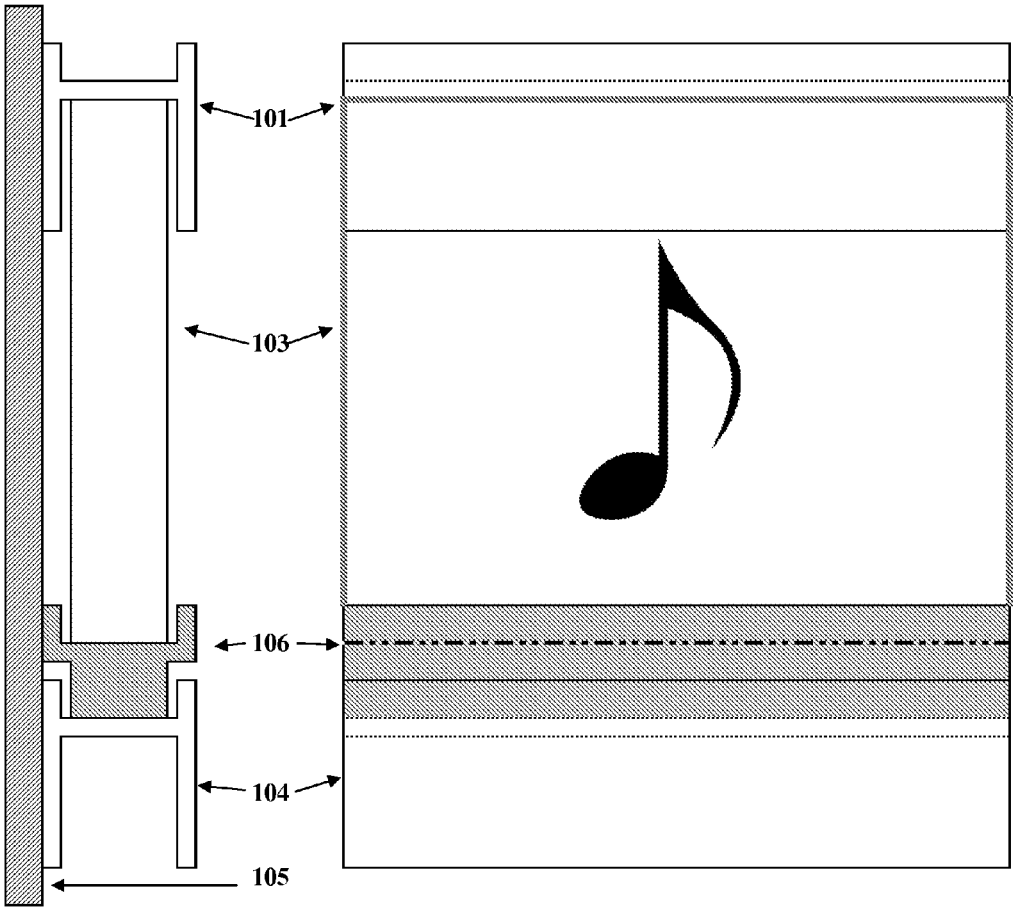

FIG. 10 illustrates a front and side view of the components of FIG. 9 embodiment of the album cover display device as it would appear during the installation process in accordance with the present disclosure. In this illustration, supporting rail 104 is immovably attached to wall 105 with adhesive or some other method, installation rail 106 is placed on top of lower supporting rail 104, and media 103 is placed on top of installation rail 106. The lower channel of upper supporting rail 101 is then placed over the top of media 103 and immovably attached to the wall using adhesive or some other method. It should be noted in this illustration that placement of installation rail 106 raises media 103 approximately one-half the height of the lower channel of supporting rail 101. The function of this will be evident in the following FIG. 11 and explanation.

Figure 11:
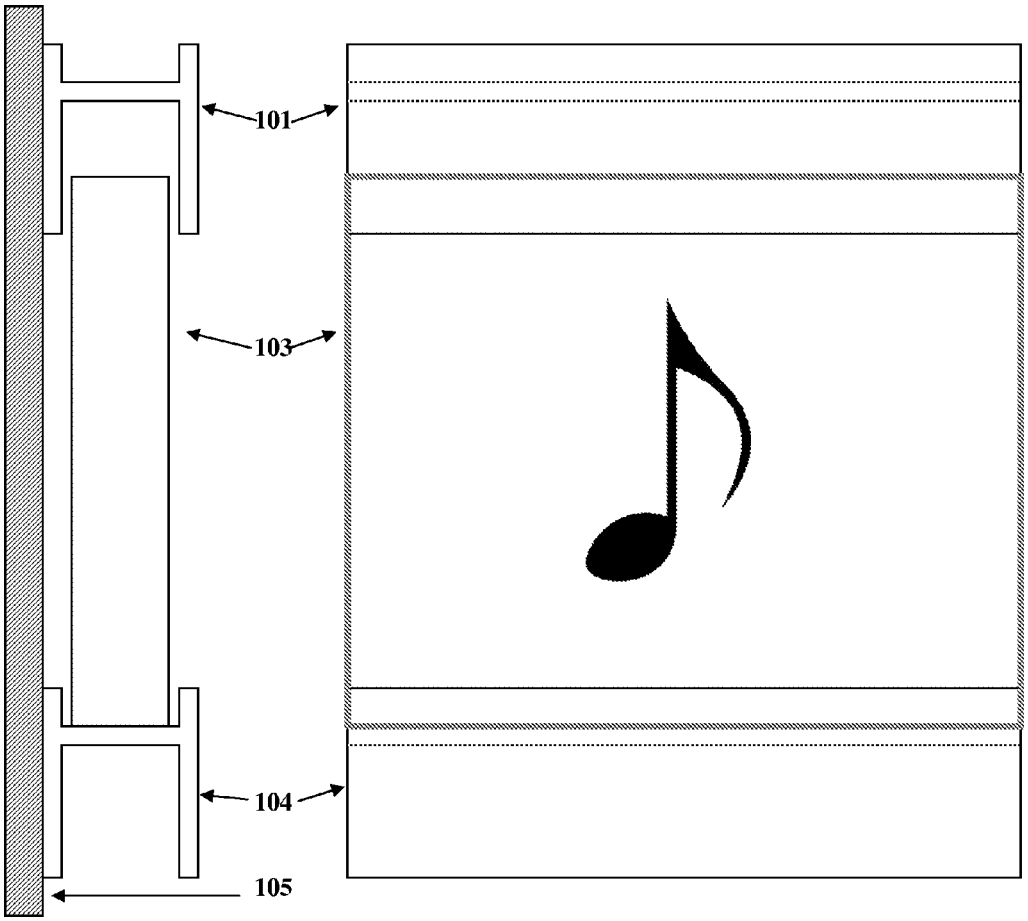

FIG. 11 illustrates a front and side view of the components of the FIG. 9 embodiment of the album cover display device as it would appear after the installation process is complete. In this illustration, upper and lower supporting rails 101 and 104 are immovable attached to wall 105 with adhesive or some other method, installation rail 106 (from FIGS. 9 and 10) has been removed with media 103 resting on top of lower supporting rail 104, the top edge secured within the lower channel of upper supporting rail 101, leaving the top edge of media 103 at approximately one-half the distance from the lowermost point of upper supporting rail 101 and the upper surface of the lower channel. This gap between the top edge of media 103 and the upper surface of the lower channel of upper supporting rail 101 allows media 103 to be lifted a sufficient distance for the lower edge of media 103 to be removed from the upper channel of lower supporting rail 104 and media 103 the be removed completely from the present disclosure.

While various embodiments of the present invention have been described in detail, it is apparent that various modifications can be made without departing from the spirit and scope of the present disclosure.

What is claimed:

1. A mounting system for displaying artwork on a wall, comprising:

a first horizontal rail configured to be attached to the wall and having a channel defined by a pair of side surfaces extending along at least a substantial portion of its longitudinal length, the channel having a sufficient width to receive an edge of the artwork;

a second horizontal rail configured to be attached to the wall at a vertical distance from the first horizontal rail and having two channels defined by side surfaces extending along at least a substantial portion of its longitudinal length, with each of two channels opening on a respective top and bottom of the rail so that the second horizontal rail has a generally cross-sectional "H" shape, with each channel being of a sufficient width to receive an edge of the artwork; and a spacer removably fitted over one end of the artwork to assist in determining the vertical distance of the second horizontal rail from the first horizontal rail, such that once the first and second horizontal rails are attached, the spacer is removable from the artwork.

2. The system of claim 1, wherein a first of the channels of the second horizontal rails has a height that is greater than a height of the second of the channels of the second horizontal rail.

3. The system of claim 1, wherein said horizontal rails are of a length sufficient to accommodate a plurality of objects.

4. The system of claim 1, wherein said system is adapted for supporting a plurality of objects in one substantially horizontal row.

5. The system of claim 1, wherein the spacer is of a generally rectangular cross-sectional shape, the longer sides of said rectangle being vertical and the shorter sides of said rectangle forming a width suitable for insertion into one of the channel of the first horizontal rail, the first channel the second horizontal rail, and the second channel of the second horizontal rail, and having a longitudinal vertical channel of a sufficient width to accept the upper edge of an object.

6. The system of claim 1, wherein said spacer is of a length approximately the same as said horizontal rails.

7. The system of claim 1, wherein said system is adapted for supporting a plurality of objects in one substantially vertical column.

8. The system of claim 1, and further comprising:

a third horizontal rail configured to be configured to attached to the wall at a second vertical distance from the second horizontal rail.

9. A mounting system for displaying artwork on a wall, comprising:

a first horizontal rail configured to be attached to the wall and having a channel extending along at least a substantial portion of its longitudinal length, the channel having a sufficient width to receive an edge of the artwork;

a second horizontal rail configured to be attached to the wall at a vertical distance from the first horizontal rail, the channel having a sufficient width to receive an edge of the artwork; and a spacer removably fitted over one end of the artwork to assist in determining the vertical distance of the second horizontal rail from the first horizontal rail, such that once the first and second horizontal rails are attached, the spacer is removable from the artwork.

* * * * *